US012324950B2

(12) United States Patent
Neuhaus

(10) Patent No.: US 12,324,950 B2
(45) Date of Patent: Jun. 10, 2025

(54) MOTORIZED PADDLING SIMULATOR

(71) Applicant: Oxefit, Inc., Pensacola, FL (US)

(72) Inventor: Peter Neuhaus, Pensacola Beach, FL (US)

(73) Assignee: Oxefit, Inc., Plano, TX (US)

( * ) Notice: Subject to any disclaimer, the term of this patent is extended or adjusted under 35 U.S.C. 154(b) by 954 days.

(21) Appl. No.: 17/462,237

(22) Filed: Aug. 31, 2021

(65) Prior Publication Data

US 2023/0067732 A1 Mar. 2, 2023

(51) Int. Cl.

| | |
|---|---|
| ***A63B 22/00*** | (2006.01) |
| ***A63B 21/005*** | (2006.01) |
| ***A63B 24/00*** | (2006.01) |
| ***A63B 71/06*** | (2006.01) |

(52) U.S. Cl.

CPC ..... *A63B 22/0076* (2013.01); *A63B 21/0058* (2013.01); *A63B 24/0087* (2013.01); *A63B 71/0622* (2013.01); *A63B 2022/0079* (2013.01); *A63B 2024/0093* (2013.01); *A63B 2071/0625* (2013.01); *A63B 2071/0636* (2013.01); *A63B 2071/0644* (2013.01); *A63B 2220/05* (2013.01); *A63B 2220/13* (2013.01); *A63B 2220/40* (2013.01); *A63B 2220/803* (2013.01); *A63B 2220/807* (2013.01); *A63B 2220/833* (2013.01)

(58) Field of Classification Search

CPC ..... A63B 22/0076; A63B 21/0058; A63B 24/0087; A63B 71/0622; A63B 2022/0079; A63B 2024/0093; A63B 2071/0625; A63B 2071/0636; A63B 2071/0644; A63B 2220/05; A63B 2220/13; A63B 2220/40; A63B 2220/803; A63B 2220/807; A63B 2220/833; A63B 22/0087; A63B 22/203; A63B 2071/0638; A63B 2071/0655; A63B 2220/54; A63B 2225/50; A63B 21/15

See application file for complete search history.

(56) References Cited

U.S. PATENT DOCUMENTS

| | | | | |
|---|---|---|---|---|
| 5,382,210 | A | 1/1995 | Rekers | |
| 7,666,118 | B1 | 2/2010 | Anthony | |
| 8,192,332 | B2 | 6/2012 | Baker et al. | |
| 10,471,297 | B1 * | 11/2019 | Smith | A63B 22/0076 |
| 2005/0085348 | A1 | 4/2005 | Kiefer et al. | |
| 2010/0125026 | A1 * | 5/2010 | Zavadsky | A63F 9/24 482/5 |
| 2011/0028278 | A1 | 2/2011 | Roach | |

(Continued)

FOREIGN PATENT DOCUMENTS

| | | |
|---|---|---|
| EP | 3 357 543 A1 | 8/2018 |

OTHER PUBLICATIONS

International Search Report and Written Opinion in PCT/US2022/41017 Dtd Dec. 7, 2022.

(Continued)

*Primary Examiner* — Andrew S Lo
(74) *Attorney, Agent, or Firm* — Foley & Lardner LLP

(57) ABSTRACT

A paddling simulator includes a bar, a cable attached to the bar, a motor operationally coupled to the cable such that the motor can apply a force to the cable, and a controller configured to control the motor to generate a first tension in the cable during a propulsion phase of a paddling stroke and a second tension in the cable during a recovery phase of the paddling stroke.

20 Claims, 7 Drawing Sheets

(56) References Cited

U.S. PATENT DOCUMENTS

| | | | | |
|---|---|---|---|---|
| 2013/0172153 | A1* | 7/2013 | Watterson | A63B 22/0076 482/5 |
| 2016/0271441 | A1* | 9/2016 | Hoover | A63B 22/0087 |
| 2018/0099178 | A1* | 4/2018 | Schaefer | A63B 24/0075 |
| 2018/0214729 | A1* | 8/2018 | Rubin | A63B 24/0087 |
| 2019/0344123 | A1* | 11/2019 | Rubin | A63B 21/0058 |
| 2020/0023231 | A1* | 1/2020 | Hsieh | A63B 22/0076 |
| 2020/0078635 | A1* | 3/2020 | Smith | A63B 22/0076 |
| 2020/0269122 | A1* | 8/2020 | Zitvogel | A63F 13/803 |
| 2021/0354002 | A1* | 11/2021 | Schaefer | A63B 71/0622 |
| 2021/0394011 | A1 | 12/2021 | Neuhaus et al. | |
| 2022/0062738 | A1* | 3/2022 | Neuhaus | A63B 33/002 |
| 2022/0088435 | A1* | 3/2022 | Gatta | A63B 24/0062 |
| 2022/0118304 | A1* | 4/2022 | McNally | A63B 21/0058 |
| 2022/0362624 | A1* | 11/2022 | Dalebout | A63B 21/4034 |
| 2023/0226413 | A1* | 7/2023 | Neuhaus | A63B 21/154 482/5 |

OTHER PUBLICATIONS

OxeFit (Twitter), Aug. 17, 2021; Stoked to be taking this journey with such an incredible partner. Goals and objectives tightly aligned—no words needed. [Tweet]. Retrieved from https://twitter.com/OxeFit/status/1427676599609036805?s=208t=F Lm3s9sylMmJIVQJeDGFhg; video included.

* cited by examiner

MOTORIZED PADDLING SIMULATOR

BACKGROUND

The present disclosure relates generally to exercise equipment, in particular fitness machines such as rowing machines that provide simulated paddling exercises.

As used herein, "paddling" refers to any type of paddling, including but not limited to use of an oar or paddle for rowing, crew, canoeing, kayaking, standup paddle-boarding, etc. Actual paddling is performed by a user on in a boat (canoe, kayak, paddleboard, etc.) on water using a paddle (oar, etc.). In conventional paddling technique, a user pushes the paddle through the water during a power phase (propulsion phase, etc.) of a paddling stroke in order to propel the boat forward and lifts the paddle out of the water and returns the paddle to a starting point for the power phase during a recovery phase (return phase, etc.) of the paddling stroke. The force required to move the paddle through the paddling stroke depends on whether an end of a paddle (e.g., a paddle blade) is underwater, such that the water resists the movement of the paddle (as is typical in the power phase), or above water, such that the paddle can move relatively easily through the air (as is typical in the recovery phase). A boat can be steered based on various interactions of the paddle with the water.

Conventional rowing machines have various limitations. To provide paddling exercises on dry land (e.g., in a gym), conventional rowing machines use fans moving through air or fluid to resist unspooling of a cable during the power phase of a paddling stroke. In some rowing machines, the resistance during the propulsion phase can be changed by changing the surface area of the fan, which typically requires the user to pause an exercise to adjust the equipment. Conventional rowing machines also include one or more springs that retract the cable during the recovery phase of the paddling stroke. The spring force during the recovery phase is typically fixed (i.e., not changeable after manufacturing of the rowing machine). Conventional rowing machines operate substantially the same regardless of whether or not the user's actions during the power phase would correspond to a paddle blade passing through water.

Exercise equipment including an improved paddling simulator that provides a more realistic paddling experience and/or provides dynamic and/or interactive paddling workouts is therefore desirable.

SUMMARY

One implementation of the present disclosure is a paddling simulator. The paddling simulator includes a bar, a cable attached to the bar, a motor operationally coupled to the cable such that the motor can apply a force to the cable, and a controller configured to control the motor to generate a first tension in the cable during a propulsion phase of a paddling stroke and a second tension in the cable during a recovery phase of the paddling stroke.

Another implementation of the present disclosure is a method of operating a paddling simulator. The method includes generating a first tension in a cable with an electric motor during a propulsion phase of a paddling stroke performed with a bar coupled to the cable, generating a second tension in the cable with an electric motor during a recovery phase of the paddling stroke, tracking a pose of the bar coupled to the cable using a sensor, and dynamically adjusting the first tension based on the pose of the bar.

This summary is illustrative only and is not intended to be in any way limiting.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Referring generally to the figures, a paddling simulator with motorized force production and methods of operation relating thereto are shown, according to various embodiments. As detailed below, the paddling simulator described herein uses one or more electric motors to provide a variable tension to a cable connected to a bar which a user can hold to perform a paddling exercise. The motors are controllable to dynamically vary the tension in the cable, including in both the power and recovery phases of a paddling stroke, for example to provide dynamic workouts not possible with conventional rowing machines. In some embodiments, the tension in the cable is varied based on whether a simulated (e.g., virtual) paddle is above or below a virtual water level in order to create a more realistic paddling experience. Additionally, the one or more motors can be controlled differently for different types of paddling strokes (rowing, kayaking, canoeing, etc.) thereby providing a variety of types of paddling exercises.

These and other advantages of the systems and methods disclosed herein are described in detail below.

Figure 1:
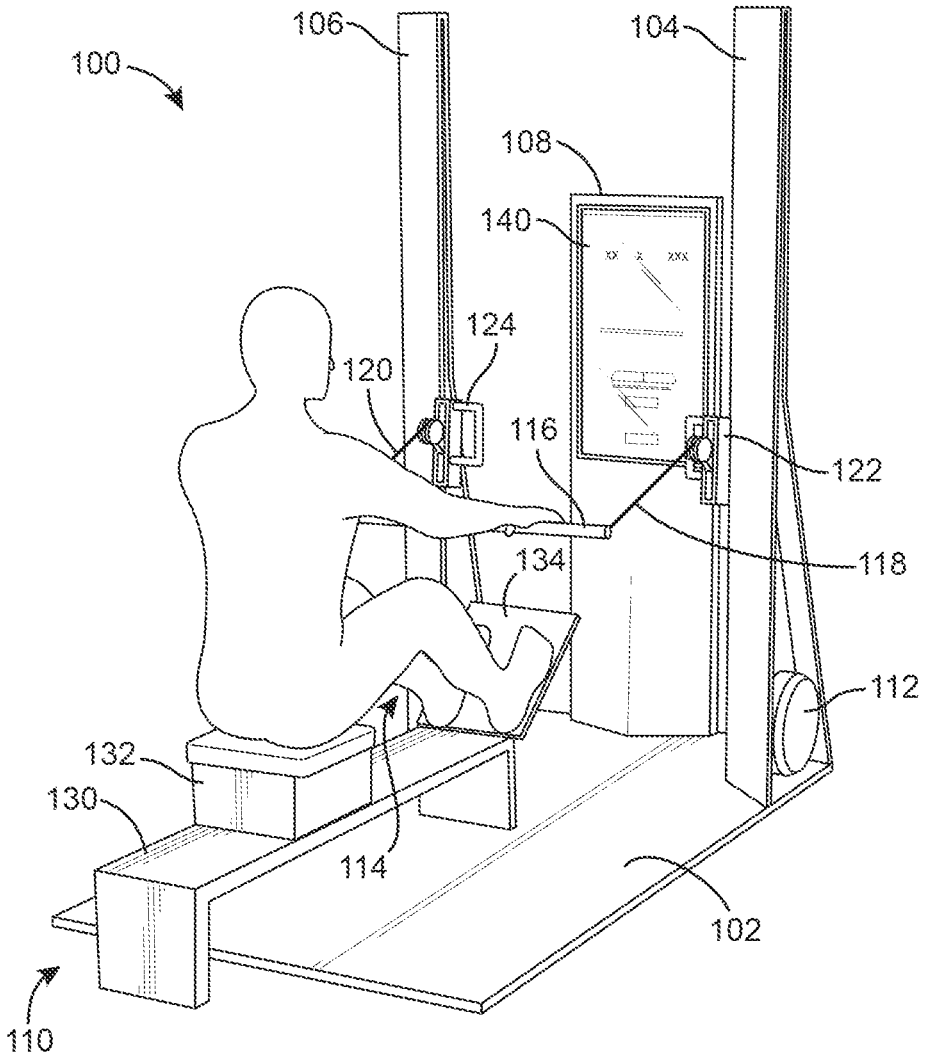
FIG. 1 is a perspective view of a paddling simulator, according to some embodiments.

Referring now to FIG. 1, a paddling simulator 100 is shown, according to some embodiments. The paddling simulator 100 is shown as including a base platform 102, a first stanchion 104 extending vertically from the base platform 102 proximate a first end of the base platform 102, a second stanchion 106 extending vertically from the base platform 102 proximate the first end of the base platform 102, a display console 108 coupled to the base platform 102 and positioned between the first stanchion 104 and the second stanchion 106, and a bench 110 positioned on the base platform 102. The paddling simulator 100 also includes a first motor 112 positioned on the base platform 102 at the first stanchion 104 and a second motor 114 positioned on the base platform 102 at the second stanchion 106. The paddling simulator 100 includes a bar 116, a first cable 118 extending from the first motor 112 to the bar 116, and a second cable 120 extending from the second motor 114 to the bar 116. The paddling simulator 100 also includes a first pulley 122 coupled to the first stanchion 104 and arranged to redirect the first cable 118 between the first motor 112 and the bar 116 and a second pulley 124 coupled to the second stanchion 106 and arranged to redirect the second cable 120 between the second motor 114 and the bar 116.

As shown in FIG. 1, the base platform 102 is substantially planar is configured to stably rest on a floor or other ground surface to provide a stable foundation for the paddling simulator 100. The base platform 102 can define an exercise surface on which a user can perform one or more exercise and/or on which the bench 110 can be positioned. In some embodiments, the base platform 102 is configured to be at least partially foldable into an out-of-use configuration in which the base platform 102 is folded up and away from the floor or ground under the base platform 102 (thereby reducing the space occupied by the paddling simulator 100 when not in use).

The first stanchion 104 and the second stanchion 106 extend upwards from the base platform 102 and are spaced apart from one another near an end of the base platform 102. The first stanchion 104 and the second stanchion 106 are shown as being substantially symmetric across a center line of the base platform 102. As shown in FIG. 1, the first stanchion 104 and the second stanchion 106 are substantially the same height. The first stanchion 104 and the second stanchion 106 may be approximately six feet tall, for example with a height in a range between five feet and seven feet, as in the example of FIG. 1. In other embodiments, the first stanchion 104 and the second stanchion 106 may be shorter, for example with a height in a range between two feet and four feet.

The first pulley 122 is coupled to the first stanchion 104 and is configured to be selectively repositioned along the first stanchion 104. For example, the first pulley 122 may include a projection that rides along a groove or slot of the first stanchion 104 (or vice-versa) and can be selectively held in place at various heights using a pin configured to engage apertures of the first stanchion 104. The first pulley 122 can include a handle to facilitate repositioning of the pulley 122. The second pulley 124 is coupled to the second stanchion 106 and is configured to be selectively repositioned along the second stanchion 106. For example, the second pulley 124 may include a projection that rides along a groove or slot of the second stanchion 106 (or vice-versa) and can be selective held in place at various heights using a pin configured to engage apertures of the second stanchion 106. The second pulley 124 can include a handle to facilitate repositioning of the pulley 122. Accordingly, the first pulley 122 and the second pulley 124 can be repositioned (e.g., manually by a user) to various heights along the first stanchion 104 and the second stanchion 106, i.e., at various heights above the base platform 102. In some embodiments, actuators (e.g., linear actuators) are included in the first stanchion 104 and the second stanchion 106 to automatically move the first pulley 122 and the second pulley 124.

The first motor 112 is shown as being positioned on the base platform 102 at a bottom end of the first stanchion 104. The first motor 112 is operationally coupled to the first cable 118 such that the first motor 112 can generate tension in the first cable 118. In some examples, the first motor 112 can include an electric motor coupled to a spool such that the electric motor operates to generate a torque that rotates the spool. In such examples, the spool is coupled to the first cable 118 such that the first cable 118 can be repeatedly wound and unwound from the spool of the first motor 112 by operation of the first motor 112.

The first motor 112 is configured to controllably generate a force that acts both acts to retract the first cable 118 towards the first motor 112 and to resists the first cable 118 from being pulled out (unspooling, releasing) from the first motor 112. Thus, as detailed below, the first motor 112 can provide a controllable tension in the first cable 118 during both a power phase and a recovery phase of a paddling stroke performed using the bar 116. The first motor 112 can also be configured to detect a transition from the power phase to the recovery phase (and from the recovery phase to the power phase), and, in some scenarios, change the tension in the first cable 118 in response to the transition. In such examples, the first motor 112 is thereby configured to provide a first tension in the first cable 118 during a power phase of a paddling stroke and a second tension in the first cable 118 during a recovery phase of the paddling stroke. In some embodiments, the first motor 112 includes a permanent magnet direct current motor.

The second motor 114 is shown as being positioned on the base platform 102 at a bottom end of the second stanchion 106. The second motor 114 is operationally coupled to the second cable 120 such that the second motor 114 can generate tension in the second cable 120. Other than acting on the second cable 120 rather than the first cable 118, the second motor 114 is configured substantially the same as the first motor 112 in the examples shown.

The bar 116 (rod, shaft, etc.) is coupled to the first cable 118 and the second cable 120. As shown in FIG. 1, the first cable 118 is coupled to the bar 116 proximate a first end of the bar 116 and the second cable 120 is coupled to a second end of the bar 116, such that the bar 116 substantially extends from the first cable 118 to the second cable 120. The bar 116 is rigid, and may include surface texturing or a surface material configured to facilitate grip of the bar 116 by a user. As shown in FIG. 1, the bar 116 is a substantially straight rod or shaft with a circular cross section. In other embodiments, the bar 116 is another shape (e.g., curved, winged, flat, etc.). In some embodiments, the bar 116 is shaped as a paddle or oar, for example with a paddle blade positioned at one or both ends thereof and/or with an ergonomic grip at one or both ends (e.g., as found on canoe paddles).

The bar 116 is coupled to the first cable 118 and the second cable 120 such that the tension in the first cable 118 and the second cable 120 is transferred to the bar 116 to create a force on the bar 116. In some embodiments, the first cable 118 and the second cable 120 are selectively coupled to the bar 116, for example using carabineers or other releasable connection mechanism. In such embodiments, the first cable 118 or the second cable 120 can be detached from the bar 116, for example to transition to a different paddling mode (e.g., to switch from a rowing or kayaking mode to a canoeing or paddle-boarding mode).

Figure 2:
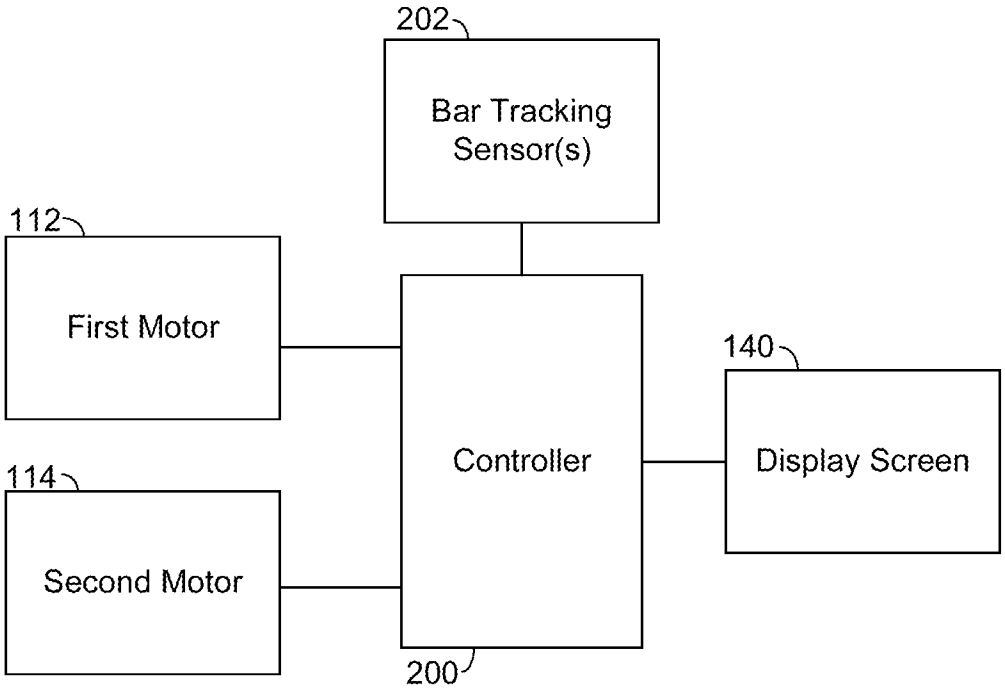
FIG. 2 is a block diagram of electronic components of the paddling simulator, according to some embodiments.

In some embodiments, the bar 116 includes one or more inertial measurement units (inertial sensors, accelerometers, gyroscopes, etc.) configured sense movement of the bar 116. The one or more inertial measurement units can be configured to sense translation and/or rotation of the bar 116 and generate data indicative of a current pose of the bar 116 (e.g., based on detected movement and a known starting positon, for example). The inertial measurement units can be communicable with a controller (e.g., wirelessly) for the first motor 112 and the second motor 114 as shown in FIG. 2 and described in detail with reference thereto.

The bench 110 is configured for use with multiple types of paddling exercises. As shown in FIG. 1, the bench 110 includes a deck 130 and seat 132 positioned on the deck 130. In the arrangement shown, the seat 132 is slidable along the deck 130, for example along a rail or slot defined by the deck 130. In such an arrangement, the bench 110 is arranged for use in a rowing exercise or other type of paddling in which a user repeatedly bends and straightens their legs during the paddling (rowing) stroke. As shown in FIG. 1, the bench 110 also includes a foothold 134 configured to support a user's feet, for example such that the user can push against the foothold 134 to help the user exert a force on the bar 116 during a paddling stroke. In some embodiments, the foothold 134 includes straps or baskets configured to retain the user's feet at the foothold 134. In some embodiments, the deck 130 slopes downwards towards the foothold 134.

In some embodiments, the bench 110 is configured to transition from the slidable arrangement of FIG. 1 to a static arrangement in which the seat 132 is locked in a static position relative to the deck 130. In such an arrangement, the bench is arranged for use in a kayaking or canoeing exercise or other paddling exercise which does not typically involve gross movement of the user's lower body. In some embodiments, the seat 132 includes a pin, clamp, latch, etc. that can be engaged to the deck 130 to prevent motion of the seat 132 relative to the deck 130 and disengaged to allow motion of the seat 132 relative to the deck 130. In other embodiments, the deck 130 includes a pin, clamp, latch, etc. that can be engaged to the seat 132 to prevent motion of the seat 132 relative to the deck 130 and disengaged to allow motion of the seat 132 relative to the deck 130.

The display console 108 is configured to display information relating to operation of the paddling simulator 100 to a user. As shown in FIG. 1, the display console 108 includes a screen 140 (e.g., LED screen) positioned to be within the line-of-sight of a user seated on the bench 110. In some embodiments, the screen 140 is a touchscreen configured to accept user input. In other embodiments, one or more additional buttons, keys, toggles, etc. are included on the display console 108 to receive user input. In some embodiments, the display console 108 includes one or more speakers configured to emit sounds relating to operation of the paddling simulator 100. In some embodiments, the paddling simulator alternatively or additionally includes a virtual reality or augmented reality headset configured to be worn by a user and to display information relating to operation of the paddling simulator 100 to the user. In some embodiments, the display console 108 houses a controller for the paddling simulator 100, for example a controller as shown in FIG. 2 and described with reference thereto below.

Referring now to FIG. 2, a block diagram of electronic components of the paddling simulator 100 is shown, according to some embodiments. As shown in FIG. 2, the paddling simulator 100 includes a controller 200 communicably coupled to the first motor 112, the second motor 114, the display screen 140, and one or more bar position sensors (bar tracking sensors) 202. The controller 200, the first motor 112, the second motor 114, the display screen 140, and the one or more bar position sensors may be conductively connected (e.g., wired connections therebetween) or wirelessly connected (e.g., Bluetooth, WiFi, etc.).

The one or more bar position sensors 202 are configured to generate data indicative of a pose (e.g., position and orientation) of the bar 116. In some embodiments, the one or more bar position sensors 202 include one or more inertial measurement units configured to generate data indicative of acceleration and movement of the bar 116. In such embodiments, the bar position sensors 202 can be positioned inside the bar 116 and wirelessly communicable with the controller 200 (e.g., via WiFi.

In other embodiments, the one or more bar position sensors 202 include optical tracking detectors, for example cameras. In some such embodiments, a camera collects visual images which are processed (e.g., using an image recognition program) to recognize the bar 116 and determine a pose of the bar 116. In other embodiments, fiducial markers, for example reflective markers, are positioned on the bar 116 (e.g., at ends of the bar 116) and an optical tracking detector (e.g., a stereoscopic camera pair) is arranged to collect data indicative of the pose of the bar 116 by optically tracking the position of the markers (e.g., by collecting infrared light emitted by the optical tracking detector and reflected by the reflective markers. Other types of tracking are possible in various embodiments.

The controller 200 is configured to receive data from the one or more bar position sensors 202, the first motor 112, and the second motor 114 and control the first motor 112, the second motor 114, and the display screen 140. The controller 200 may include one or more processors and one or more non-transitory computer-readable media storing program instructions executable to perform the operations attributed thereto herein. The controller 200 can be a single device (e.g., fully contained in a single position on the paddling simulator 100) or may include multiple distributed computing components (e.g., spatially distributed in various positions on the paddling simulator 100).

The controller 200 is configured to determine tensions to generate in the first cable 118 and the second cable 120 (or motor torques corresponding thereto) at various phases of paddling strokes to enable various workouts as discuss elsewhere herein. The controller 200 is also configured to control the first motor 112 and the second motor 114 to achieve the target tensions. The controller 200 is also configured to generate and adjust a graphical user interface for display via the display screen 140. Various processes executable by the controller 200 in various scenarios and embodiments are described below with reference to FIGS. 3-8.

To control the first motor 112 to provide a target tension in the first cable 118, in some embodiments the controller 200 implements a control loop in which the first motor 112 provides a measurement of a torque generated by the first motor 112 and the controller 200 adjusts a control input for the first motor 112 to drive the measured torque toward a setpoint associated with the target tension. The controller 200 may provide a proportional-integral or proportional-integral-derivative feedback controller, for example. The target tension in the first cable 118 can thus be generated in a highly accurate manner. Such an approach also allows the controller 200 to adapt nearly continuously to changes in the force applied to the bar 116 by a user, for example such that the user does not experience perceptible lag times as the tension in the first cable 118 is updated. The controller 200 can apply a separate, similar control loop for the second motor 114, such that the controller 200 independently controls the first motor 112 and the second motor 114 (and thus independently controls the tensions in the first cable 118 and the second cable 120) in a coordinate manner.

The controller 200 can also control the display screen 140, for example by generating one or more visualizations for display via a graphical user interface. In some embodiments, the controller 200 generates a virtual environment, for example including a virtual water level (e.g., a virtual volume of water defined relative to a reference point. In such embodiments, the controller 200 can generate a visualization of movement of a virtual boat and/or a virtual paddle in the virtual environment based on data from the first motor 112, the second motor 114, and/or the bar tracking sensor(s) 202. The virtual environment may include one or more obstacles and can enable gamification of a paddling workout for a user of the paddling simulator 100. The first motor 112 and the second motor 114 can also be controlled by the controller 200 as a function of a virtual paddle's pose in the virtual environment. Additional details of related features are described in detail below with reference to FIGS. 6-8.

Figure 3:
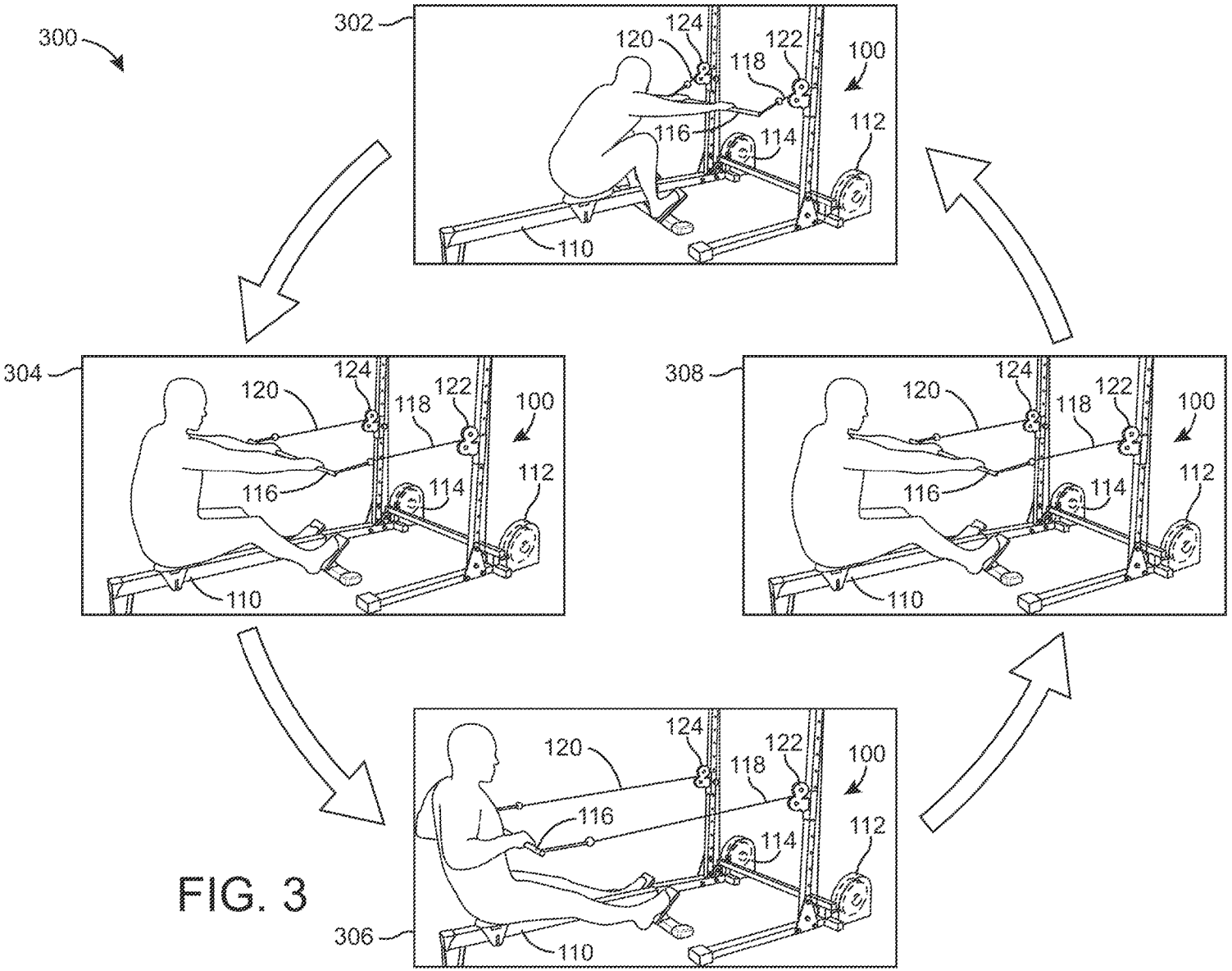
FIG. 3 is an illustration of operation of the paddling simulator through a rowing stroke, according to some embodiments.

Referring now to FIG. 3, an illustration 300 of operation of the paddling simulator 100 through a rowing stroke is shown, according to an exemplary embodiment. The illustration 300 shows a cycle through a first phase 302, a second phase 304, a third phase 306, and a fourth phase 308 of the rowing stroke. The paddling simulator 100 is configured to provide an exercise for a user as the user repeatedly cycles through the phases shown in FIG. 3. As shown in FIG. 3, the paddling simulator 100 is configured as shown in FIG. 1.

In the first phase 302, the user is in the catch phase of a rowing stroke. An exercise can be initiated from the first phase 302. At the first phase 302, the controller 200 can operate to control the first motor 112 and the second motor 114 to start providing a first tension in the first cable 118 and the second cable 120. The first cable 118 and the second cable 120 are largely retracted by the first motor 112 and the second motor 114 at the first phase 302, for example so that the bar 116 can be held proximate the pulleys 122, 124 without slack in the cables 118, 120.

In the second phase 304, the user is in the power (propulsion) phase of a rowing stroke. The user extends the user's legs and pulls on the bar 116 with the user's hands to move through the second phase 304. During the second phase 304, the controller 200 causes the first motor 112 and the second motor 114 to generate torque to resist the user's force on the bar, e.g., to resist the unspooling of the first cable 118 and the second cable 120. The first motor 112 and the second motor 114 thus provide a controllable amounts of tension in the first cable 118 and the second cable 120, which can be dynamically controlled and independently varied depending, for example, on a workout plan for the user.

For example, in some scenarios equal tension is generated in both cables 118, 120, thus providing an even/balanced force to the user. In other scenarios an uneven tension is generated (i.e., a higher or lower tension in the first cable 118 compared to the second cable 120) to cause asymmetric loading of the user which can cause activation of additional muscles for the user. The controller 200 can vary the tension in the first cable 118 and the second cable 120 according to user settings, in order to follow a pre-defined workout routine, in order to cause the user to achieve a target speed or acceleration of the bar 116, etc., during the second phase 304.

At the third phase 306, the user is at the finish phase of the rowing stroke, where an oar blade would exit the water in an actual rowing scenario. At the third phase 306, the user stops pulling the bar 116 away from the pulleys 122, 124 and exerts zero or low force on the bar 116 in the direction away from the pulleys 122, 124. The first motor 112 and the second motor 114 are configured to detect the change in movement of the cable associated with occurrence of the third phase 306, and to provide an indication of the occurrence of the third phase 306 to the controller 200. In response, the controller 200 can control the first motor 112 and the second motor 114 to transition from generating tensions suitable for the second phase 304 (power phase) to generating tensions suitable for the fourth phase 308 (recovery phase) of the rowing stroke.

At the fourth phase 308 (the recovery phase), the user moves the bar 116 back toward the pulleys 122, 124. The first motor 112 and the second motor 114 operate to retract the first cable 118 and the second cable 120 while providing a non-zero tension in the first cable 118 and the second cable 120. The first cable 118 and the second cable 120 are thereby retracted with approximately the same speed that the user moves the bar 116 toward the pulleys 122, 124.

Advantageously, the tension provided during the fourth phase 308 is dynamically adjustable by operation of the motors 112, 114. For example, in some embodiments a relatively low tension is provided to gently retracted the first cable 118 and the second cable 120 while allowing a user to easily move back to the first phase 302. In other scenarios, a higher tension is provided to forcefully pull the bar 116 toward the pulleys 122, 124, such that a user is compelled to resist the movement of the bar 116 via an eccentric exercise. An eccentric exercise can thus be dynamically added or removed from the paddling stroke of illustration 300 as desired, for example according to user inputs (e.g., voice commands), predefined workout plans, interactions with a virtual environment, etc. As for the second phase 304, the tensions provided in the third phase can be equal (symmetric) or unequal (asymmetric) to provide various workouts to the user.

Following the fourth phase 308, the rowing stroke of illustration 300 returns to the first phase 302 (the catch phase), at which the user stops the movement of the bar 116 toward the pulleys 122, 124 and starts motion of the bar 116 away from the pulley 122, 124. The first motor 112 and the second motor 114 are configured to detect occurrence of the first phase 302 and provide an indication of occurrence of the first phase 302 to the controller 200. The controller 200 can then transition operation of the first motor 112 and the second motor 114 from providing the tension used in the fourth phase 308 (recovery phase) to the tension used in the third phase 306, thus restarting the cycle through the phases of the rowing stroke shown in the illustration 300 of FIG. 3. FIG. 3 thereby illustrates that the paddling simulator 100 can operate to provide a rowing-type paddling workout.

Figure 4:
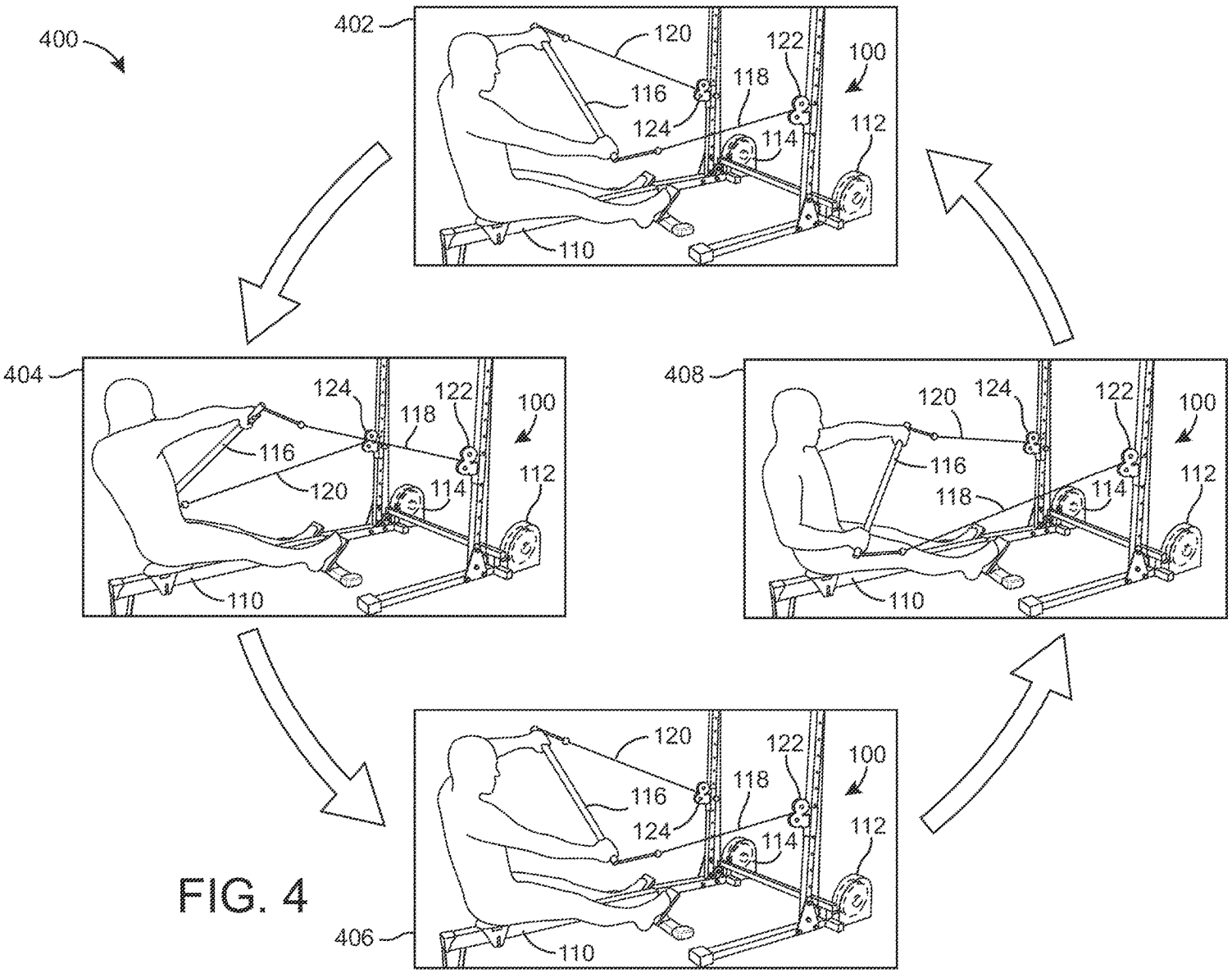
FIG. 4 is an illustration of operation of the paddling simulator through a kayaking stroke, according to some embodiments.

Referring now to FIG. 4, an illustration 400 of the paddling simulator 100 providing a kayaking-type paddling workout is shown, according to some embodiments. The illustration 400 shows a first neutral phase 402, a left power phase 404, a second neutral phase 406, and a right power phase 408 which combine to provide a simulated kayaking workout to a user. The paddling simulator 100 is configured as described above in the example of FIG. 5, with the seat 132 fixed in position relative to the deck 130 of the bench 110.

The first neutral phase 402 provides a starting place for a kayaking stroke. As shown for the first neutral phase 402, the bar 116 may be held substantially sideways (horizontal, parallel to the base platform 102. The first motor 112 and the second motor 114 can be controlled to allow the user to move the bar 116 into the pose shown for the first neutral phase 402 with little or no resistance. In the first neutral phase 402, paddle blades would be out of the water, and the controller 200 can determine that virtual paddle blades are above a virtual water level in the first neutral phase 402 based on a tracked pose of the bar 116. In some embodiments, the first motor 112 and the second motor 114 provide a minimal tension (e.g., sufficient to prevent slack in the cables 118, 120) in the first neutral phase 402 and until such time as the tracked pose of the bar 116 indicates that a virtual paddle blade would be under a virtual water level.

A user can initiate the exercise by moving either the left or right end of the bar 116 downwards. In the example of FIG. 3, the illustration 400 shows the user moving first into a left power phase 404 of the kayaking stroke. In the left power phase 404, the left end of the bar 116 is brought downwards, as would be done to place the left blade of a kayaking paddle in the water, and then the left end of the bar 116 is drawn backwards, i.e., away from the second pulley 124 causing the second cable 120 to release from the second motor 114. Meanwhile, the right end of the bar 116 may be brought closer to the first pulley 122, with the first motor 112 operating to retract any slack created in the first cable 118 by such a movement.

The controller 200 can control the second motor 114 to provide a tension that resists movement of the bar 116 (in particular, resists movement of a point on the bar 116 to which the second cable 120 is attached) through the left power phase, thereby simulating the resistance of a paddle blade at a left end of the bar 116 through water. In some embodiments, the second motor 114 is configured to detect when the user applies a force corresponding to the left power phase 404 to the bar 116 and second cable 120 (e.g., based on a corresponding movement of the second cable 120), and to initiate force production for the left power phase 404 in response to detecting such a force or movement.

In some embodiments, the controller 200 is configured to control the second motor 114 during the second power phase using data from the one or more bar tracking sensors 202 (e.g., inertial sensors). In such embodiments, the controller 200 can define a virtual water level in a virtual coordinate system and determine, based on the data from the one or more bar tracking sensors 202, a pose of a virtual paddle relative to the virtual water level corresponding to an actual, tracked position of the bar 116. The controller 220 can then determine whether a blade (e.g., left or right blade in the kayaking example of FIG. 4) of the virtual paddle is above or below the virtual water level. If, in the example of the left power phase 404, the left virtual paddle blade is determined to be below the virtual water level, the controller 200 controls the second motor 114 to apply a substantial tension in the second cable 120 that resists movement of the virtual paddle blade through the virtual water, i.e., provides a force on the bar 116 that the user must overcome to complete the left power phase 404 of the paddling stroke. If, however, the left virtual paddle blade is determined to be above the virtual water, the controller 200 controls the second motor 114 to apply a minimal or negligible tension, such that the user can freely move the bar 116 through the air (and move the virtual paddle through space above the virtual water level). The controller 200 can thereby control the second motor 114 to only apply a desired tension for a power phase of a paddling stroke when the has oriented the bar 116 such that a virtual paddle blade is below a virtual water level.

As illustrated in FIG. 4, following the left power phase 404, the kayaking exercise can proceed to a second neutral phase 406. In the second neutral phase 406, the bar 116 is returned to a horizontal position (e.g., with both ends above a virtual water level). To provide for the transition from the left power phase 404 to the second neutral phase 406, the controller 200 can control the second motor 114 to reduce the tension in the second cable 120, for example in response to a determination that the virtual paddle has been lifted out of the virtual water or in response to detecting that a user stopped providing a backwards force on the bar 116 (and thus a torque on the second motor 114). Thus, in the second neutral phase 406, a minimal (e.g., negligible) tension may be provided in the first cable 118 and the second cable 120, for example only sufficient to retract any tension in the first cable 118 and the second cable 120 without exerting a substantial force on the bar 116 or the user. The user is thereby allowed to freely manipulate the bar 116 (i.e., resisted by substantially only the weight of the bar 116) through the second neutral phase 406 to transition from the left power phase 404 to a right power phase 408.

In the right power phase 408, the user tilts the bar 116 clockwise, moving the right end of the bar 116 downwards as if to place a right paddle blade of a kayak paddle into water. In response to initiation of the right power phase 408, the controller 200 can control the first motor 112 to increase the tension in the first cable 118 to provide resistance to backwards movement of the right end of the bar 116 (i.e., the point at which the first cable 118 attaches to the bar 116). The first motor 112 thereby acts to resist movement of bar 116 away from the first pulley 122. The user must exert a force to overcome such resistance, thereby participating in a kayaking workout/exercise.

To provide the right power phase 408, the controller 200 can control the first motor 112 as discussed above for the second motor 114 in the left power phase 404. For example, in some embodiments, the first motor 112 can detect when the user has started to pull the bar 116 away from the first pulley 122 (e.g., based on a change in torque exerted on the first motor 112 via the first cable 118), and the controller 200 can control the first motor 112 to increase the tension in the first cable 118 in response to the detection. As another example, as described above, the controller 200 can use data from the one or more bar tracking sensors 202 to update, in real-time (i.e., at a sufficiently high frequency as to appear continuous to a user), a virtual pose of a virtual paddle relative to a virtual water level that corresponds to an actual pose of the bar 116 in real space. In such examples, the controller 200 can control the first motor 112 to increase the tension in the first cable 118 in response to determining that a right virtual paddle blade of the virtual paddle is below the virtual water level, while controlling the first motor 112 to provide a minimal/negligible tension in the first cable 118 otherwise. The paddling simulator 100 can thereby provide the user with a simulated kayaking experience which realistically responds to a pose of the bar 116

Following the right power phase 408, the kayaking exercise of FIG. 4 returns to the first neutral phase 402. The illustration 400 of FIG. 4 shows that the user can repeatedly cycle through the phases of the kayaking paddling stroke to conduct a kayaking workout. Although FIG. 4 shows a certain order of phases, it should be understood that a user may complete consecutive left power phases 404 without necessarily completing a right power phase 408 in between (and vice versa), and the controller 200 is adapted to dynamically respond to the movement of the bar 116 to allow for any such scenarios. Such flexibility may be especially advantageous for enabling simulations in which the user is able to steer a virtual boat, as described below with reference to FIG. 8.

Figure 5:
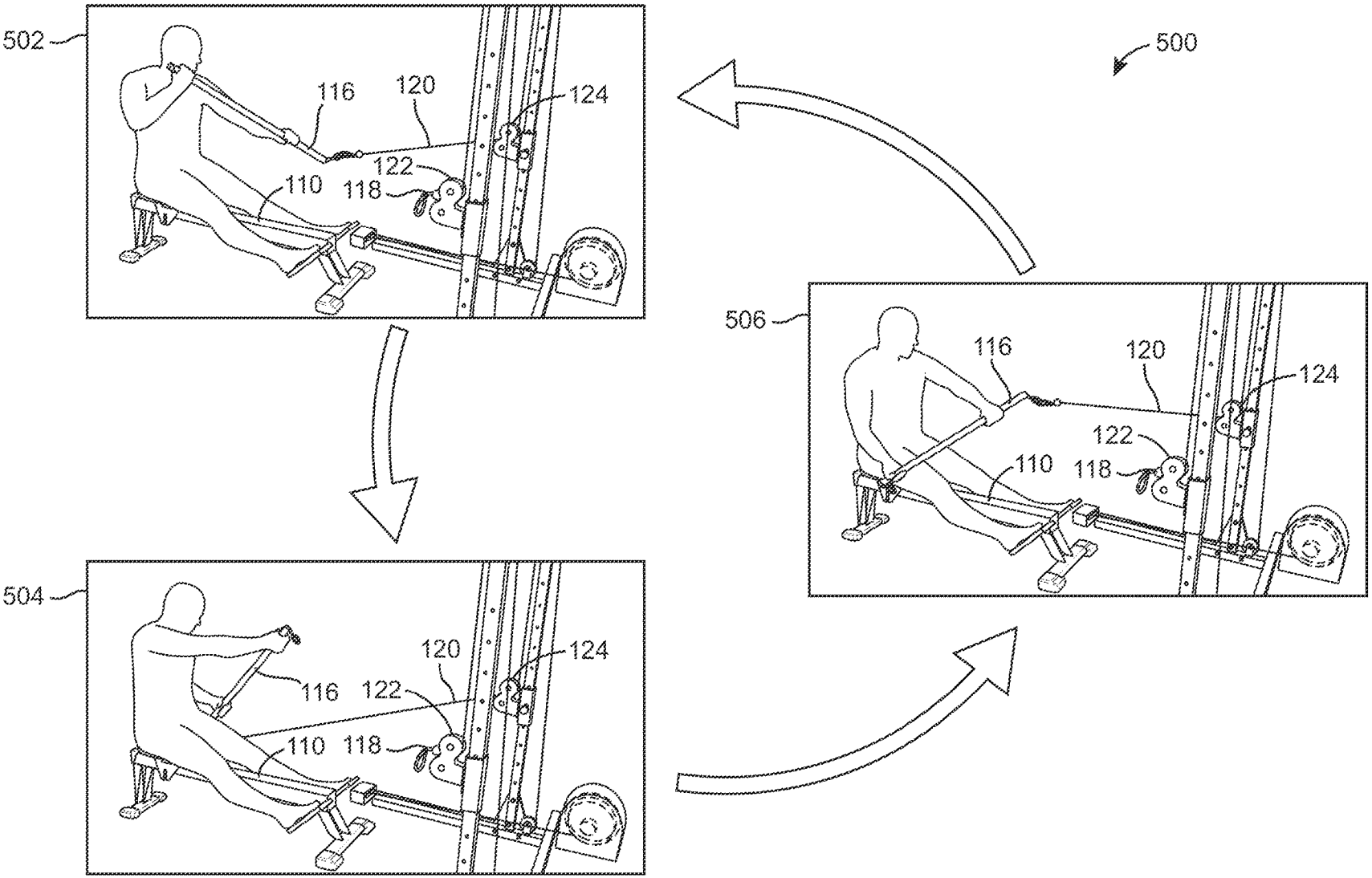
FIG. 5 is an illustration of operation of the paddling simulator through a canoeing stroke, according to some embodiments.

Referring now to FIG. 5, an illustration 500 of a canoeing exercise performed with the paddling simulator 100 is shown according to an example embodiment. Canoeing is performed with a canoe paddle having a blade on one end and a handle on the other, such that only on end of the blade is placed in the water. To provide similar dynamics, the illustration 500 shows that the first cable 118 has been detached from the bar 116, while the second cable 120 remains attached to the bar 116. It should be understood that a similar arrangement could be achieved by keeping the first cable 118 attached to the bar 116 while the second cable 120 is detached from the bar 116, with references in the following description to the second motor 114 replaced with the first motor 112. In other embodiments, the canoeing exercise is performed with both the first cable 118 and the second cable 120 attached to the same end of the bar 116, and both the first motor 112 and the second motor 114 are controlled in a coordinated manner to provide suitable force profiles. In some embodiments, the bar 116 includes a canoe-style grip at an end so that the bar 116 can be held like a standard canoe paddle.

As shown in FIG. 5, the canoeing exercise is performed by moving the bar 116 through a catch phase 502, a power phase 504, and a recovery phase 506. At the catch phase 502, the bar 116 is pointed partially downwards, with the second cable 120 attached at the downwards-pointing end of the bar 116 (shown as the left end of the bar). The catch phase 502 corresponds to the point at which the blade of a canoe paddle would enter the water, alongside and slightly in front of the user. The paddling exercise can thus be initiated from the catch phase 502.

In some embodiments, the controller 200 detects occurrence of the catch phase 502 based on a change in velocity of the second cable 120 (or a velocity portion of the second motor 114 connected to the second cable 120) caused by the user's force on the bar 116 and second cable 120. In other embodiments, the controller 200 uses data from the bar tracking sensors 202 to determine a position of a virtual paddle relative to a virtual water level and determine when a blade of the virtual paddle moves below the virtual water level (i.e., into the virtual water). In such embodiments, the controller 200 detects occurrence of the catch phase 502 at the time when the blade of the virtual paddle moves below the virtual water level.

In response to detecting occurrence of the catch phase 502, the controller 200 controls the second motor 114 to increase the tension in the second cable 120 to provide an amount of resistance for the power phase 504. In the power phase 504, the user drives the end of the bar connected to the away from the second pulley 124, along the user's side as if paddling a canoe. The tension in the second cable 120 resists such a motion, thereby providing difficulty to the canoe paddling workout for the user. The amount of tension provided in the power phase 504 can vary dynamically as described with reference to the FIG. 3, for example based on a pre-set workout plan, user settings, a speed of movement of the bar 116, etc.

To end the power phase 504, the user lifts up a lower end of the bar, for example by rotating the bar clockwise to move from the power phase 504 to the recovery phase 506 as illustrated in FIG. 5. The controller 200 can detect the transition from the power phase 504 to the recovery phase 506 and change (e.g., reduce) the tension in the second cable 120 in response to the detection. In some embodiments, the controller 200 detects the transition by determining that the user stopped pulling the second cable 120 away from the second pulley 124 (e.g., using data from the second motor 114 as described above). In other embodiments, the controller 200 detects the transition by using data from the one or more bar tracking sensors 202 to determine that movement of the bar 116 corresponds to lifting of a virtual paddle to a position above a virtual water line. In such embodiments, feedback can be provided to the user (e.g., audible alert, etc.) if tracked movement of the bar 116 corresponds to forward movement of the virtual paddle below the virtual water line, i.e., movement of the bar 116 toward the second pulley 124 with the virtual paddle still below the virtual water line, such that a user is informed if the recovery phase 506 has not been successfully entered. Realistic paddling behavior can thereby be encouraged from the user by the paddling simulator 100, while the paddling simulator 100 generates suitable forces on the bar 116.

From the recovery phase 506, the illustration 500 of FIG. 5 shows that the canoeing exercise can return to the catch phase 502 described above. The canoeing exercise can include cycling through the catch phase 502, power phase 504, and recovery phase 506 repeatedly for the duration of a workout. In some embodiments, the user is free to switch from paddling on the left and right sides of the user's body, for example by switching hand positions during the recovery phase 506. In some cases, the bench 110 is moveable relative to the second pulley 124 to arrange the user to enable canoe paddling with the bar 116 along the left and right sides of the user's body without interference between the second cable 120 and the user's body (legs, torso, etc.). FIG. 5 thus illustrates that the paddling simulator can provide a dynamic, realistic canoe paddling experience to a user.

Figure 6:
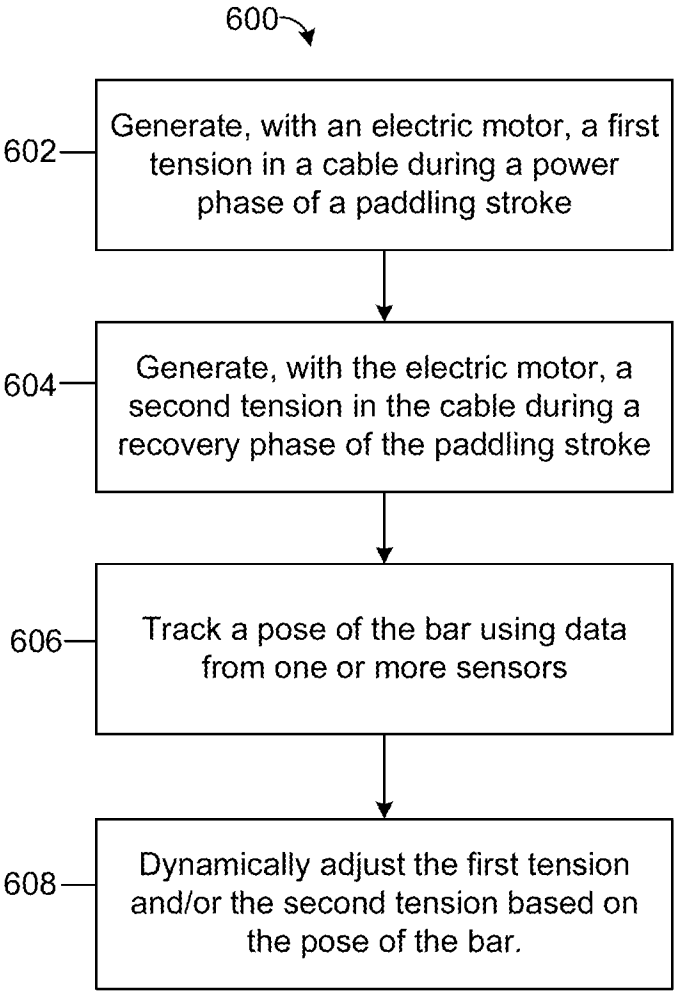
FIG. 6 is a flowchart of a process for operating the paddling simulator, according to some embodiments.

Referring now to FIG. 6, a flowchart of a process 600 of operating the paddling simulator 100 is shown, according to some embodiments. The process 600 can be executed by the paddling simulator 100, for example by the electronic components of the paddling simulator 100 shown in FIG. 2. The process 600 can also be executed by other paddling simulators, exercise equipment, etc. in various embodiments.

At step 602, a first tension is generated in a cable with an electric motor during a power phase of a paddling stroke. The paddling stroke is performed by a bar (rod, paddle, etc.) coupled to the cable, such that the cable is positioned between the bar, rod, paddle, etc. and the electric motor. For example, the cable may be the first cable 118 or the second cable 120 of FIG. 1 and the electric motor can be the first motor 112 or the second motor 114 of FIG. 1. The first tension is generated by generating a torque with the electric motor which is mechanically communicated to the cable and which opposes a force applied by a user during the power phase of the paddling stroke.

At step 604, a second tension is generated in the cable with the electric motor during a recovery phase of the paddling stroke. The second tension is different than the first tension, such that process 600 includes changing the tension in the cable from the first tension to the second tension in response to a transition from the power phase to the recovery phase of the paddling stroke. For example, the electric motor may be controlled to a different target torque using a feedback controller during step 604 as compared to step 602.

At step 606, a pose of the bar (rod, paddle, etc.) coupled to the cable is tracked using data from one or more sensors. The sensors can include sensors embedded in the bar, for example an inertial measurement unit. The sensors can also include sensors spaced apart from the bar and configure to identify a position of the bar relative to the sensors (e.g., a stereoscopic camera pair). In some embodiments, the sensors include a set of sensors configured to track amount of the cable played out from a pulley and an angle at which the cable leaves the pulley, which can be used together to determine a position of a point at which the cable is coupled to the bar. Various tracking approaches are possible at step 606 to track the pose of the bar.

Figure 7:
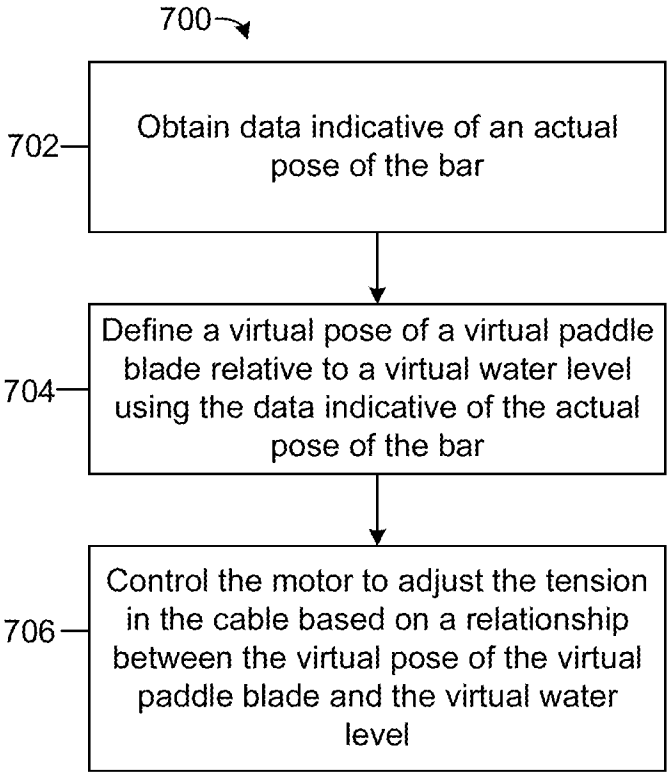
FIG. 7 is a flowchart of a process of adjusting operation of the paddling simulator based on interaction with virtual water, according to some embodiments.

At step 608, the first tension and/or the second tension are dynamically adjusted based on the pose of the bar. In one example, the first tension is adjusted based on whether a relationship between the tracked pose of the bar and a virtual water level, for example as shown in FIG. 7 and described in detail thereto. In another example, the first tension and/or the second tension is/are adjusted based on a speed of movement of the bar. As another example, the first tension may be adjusted dynamically based on the pose of the bar such that the first tension is higher at a beginning of the power phase than at the end of the power phase, or vice versa. Similarly, in some examples the second tension is adjusted dynamically to be higher at a beginning of the recovery phase as compared to the end of the recovery phase, or vice versa. As yet another example, step 608 can enable use of the bar as an input device by a user, by adjusting the first tension and/or the second tension in response to a particular movement of the bar by the user (e.g., raising or rotating the bar in a certain direction to increase tension, lower or rotating the bar in a certain direction to decrease tension, etc.). Dynamic paddling workouts can thereby be execution of process 600.

Referring now to FIG. 7, a process 700 for varying resistance to simulated paddling during a paddling workout is shown, according to some embodiments. The process 700 can be executed by the paddling simulator 100 in some embodiments, for example by the components shown in FIG. 2. The process 700 can also be executed by various other paddling simulators or exercise equipment, according to various embodiments.

At step 702, data indicative of an actual pose of the bar is obtained, for example by the controller 200 of FIG. 2. The data can be collected by sensors as described elsewhere herein, for example as in step 606 of FIG. 6. Step 702 can be repeated in real-time to obtain data indicative of movement of the bar.

At step 704, a virtual pose of a virtual paddle blade is defined relative to a virtual water level using the data indicative of the actual pose of the bar. Step 704 can include defining or calibrating a coordinate system in which the virtual water level is defined, and then mapping the actual pose of the bar into the coordinate system using the data from step 702. The mapping of the actual pose of the bar can be represented by a virtual paddle having one or more (e.g., two) paddle blades. The virtual paddle may have different dimensions than the actual bar. In some embodiments, a user is instructed to hold the bar in a particular pose or move the bar in a particular pattern in order to calibrate the relationship between the data from step 702 and the virtual coordinate system and virtual water level. Then, the virtual pose of the virtual paddle (and virtual paddle blade) can be updated in real-time as data indicating movement of the bar is collected.

At step 706, a motor (e.g., first motor 112 or second motor 114) is controlled to adjust tension in the cable (e.g., first cable 118 or second cable 120) based on a relationship between the virtual pose of the virtual paddle blade and the virtual water level. In some embodiments, the tension is increased if the virtual paddle blade is below the virtual water level and decreased as the virtual paddle blade is above the virtual water level. The paddling simulator thus resists movement of the bar corresponding to movement of the virtual paddle blade through virtual water, while provide less or no resistance to movement of the virtual paddle blade through virtual air. The relationship and control may be implemented in a binary manner, where the virtual paddle blade is characterized as either above or below the virtual water level and two tensions are selected between based on the binary characterization, or based on an at least partially continuous function, where the tension is adjusted as a function of an amount of the virtual paddle blade which is below the water level (e.g., increasing proportionally to the percentage of the virtual paddle blade determined to be below the water level). Step 706 can thus include adjusting the tension in the cable to exert a force on a user that mimics an on-water paddling experience.

Figure 8:
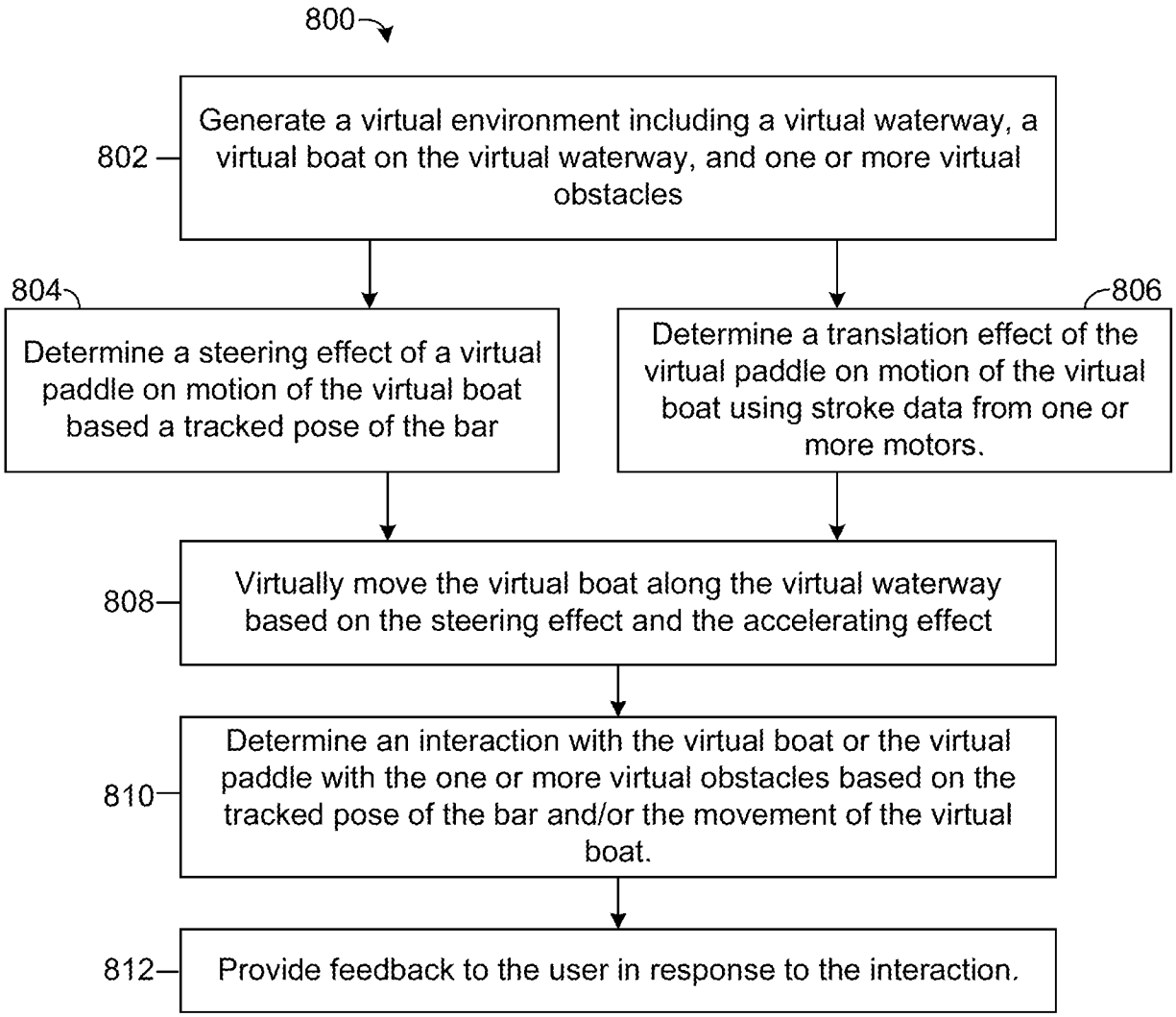
FIG. 8 is a flowchart of a process of providing an interactive virtual paddling experience with the paddling simulator, according to some embodiments.

Referring now to FIG. 8, a process 800 for providing an interactive virtual paddling experience with the paddling simulator is shown, according to some embodiments. The process 800 can be executed by the paddling simulator 100, for example, or by another embodiment of exercise equipment. Process 800 can be executed concurrently with process 600 and/or process 700.

At step 802, a virtual environment is generated, for example by the controller 200. The virtual environment includes a virtual waterway, a virtual boat on the virtual waterway, and one or more virtual obstacles. The virtual environment defines a space through which a user of the paddling simulator 100 can interactively paddle the virtual boat using the bar 116, which is represented in the virtual environment as a virtual paddle.

The virtual environment can be two-dimensional or three-dimensional. The virtual environment can include graphical visualizations of the virtual waterway, the virtual boat, and the virtual obstacles which are displayed on a screen (e.g., display screen 140) as part of step 802. Generating the virtual environment at step 802 can include defining an initial spatial relationship between the virtual boat, the virtual waterway, and the virtual obstacles. Step 802 can also include defining environmental conditions or traits of the virtual objects, for example a current in the virtual waterway, wind, etc. The virtual obstacles can be static in the virtual environment (e.g., rocks, trees, barricades, etc.), moving (e.g., enemies, alligators, floating obstacles moving along the virtual waterway, etc.), or otherwise transient or dynamic. The virtual environment can include various other features that provide for gamification of a paddling workout experience (e.g., simulated race competitors, goals, targets, collectible items, reward visualizations, etc.).

At step 804, a steering effect of a virtual paddle on the virtual boat is determined based on a tracked pose of the bar 116. As described above, the bar 116 of the paddling simulator 100 can be tracked to obtain data indicative of an actual pose of the bar 116 in real, physical space, which can then be used in step 804 to define a pose of a virtual paddle in the virtual environment. Once the pose of the virtual paddle in the virtual environment is defined, an interaction between the virtual paddle and the virtual waterway and/or the virtual boat can be analyzed to determine a steering effect of the virtual paddle on the virtual boat. For example, if the virtual paddle is moved to paddle along a left side of the virtual boat, a steering effect may be determined that steers the virtual boat to the right. Advanced steering techniques used in real-world paddling on water can be similarly modelled and implemented in step 804. In some embodiments, the steering effect may be determined using a physics-based model of paddling, fluid dynamics, etc. In other embodiments, a simplified rules-based model is used which defines explicit relationships between paddle positions and steering effects.

At step 806, an accelerating effect of the virtual paddle on motion of the virtual boat is determined using stroke data from one or more motors (e.g., the first motor 112 and the second motor 114). The stroke data can include the power exerted through each paddle stroke, a length of each paddle stroke, a duration of each paddle stroke, a speed of each paddle stroke, a frequency of paddle strokes, etc. Such data is indicative of the translation of a boat that such paddling cause in a real-world, on-water scenario, and is therefore usable to calculate an effect of the user's paddling with the bar 116 on the translation of the virtual boat along the virtual waterway. The translation effect can be considered as relating to linear acceleration, whereas the steering effect of step 804 relates to turning in other directions (e.g., left and right). Step 806 can include executing a physics-based function that uses inputs of current virtual boat speed and total power of a stroke and outputs a subsequent virtual boat speed resulting from the stroke. The function can account for resistance to movement of the virtual boat through the virtual water, a virtual current in the virtual water, wind and/or air resistance, etc., including such that the virtual boat may slow to a stop when a user stops paddling. In some embodiments, step 806 can also include determining a braking effect that particular placements of the virtual paddle may have on movement of the virtual boat.

At step 808, the virtual boat is virtually moved along the virtual waterway based on the steering effect and the accelerating effect. The combination of the steering effect (e.g., left, right) and the accelerating effect (e.g., forward, backward) results in multi-dimensional movement of the virtual boat in the virtual environment and relative to the virtual obstacles. Step 808 can include displaying the determined movement, for example via display screen 140 or via a virtual reality headset. In such embodiments, the user can view the position of the virtual boat in the virtual environment and paddle and steering using the bar 116 of the paddling simulator 100 to achieve a desired or intended movement of the virtual boat in the virtual environment. Various games, races, challenges, etc. can be provided in process 800 to motivate the user in paddling and steering the virtual boat and thereby complete fun, exciting, effective workouts that may build general fitness and potentially improve the user's abilities in real-world, on-water paddling.

At step 810, an interaction of the virtual boat or the virtual paddle with the one or more virtual obstacles is determined based on the tracked pose of the bar and/or the movement of the virtual boat. For example, the various objects in the virtual environment can be defined as geometries (volumes, surfaces, lines, points, etc.) in a three-dimensional coordinate system, such that overlap or intersection of two objects can be easily determined to identify an interaction. In one example, the virtual obstacle is a virtual alligator which moves around on the virtual waterway and threatens to destroy the virtual boat. In one scenario, the virtual alligator moves to the same position as the virtual paddle, resulting in an interaction between the virtual alligator and the virtual paddle. In some cases, the interaction could include the virtual alligator destroying the virtual paddle and causing the user to lose a game, return to a checkpoint, etc. In other cases, the interaction could include the user hitting the alligator with the virtual paddle, thereby destroying or discouraging the alligator and moving towards success in a game. Various other interactions are possible between the virtual boat or paddle and virtual obstacles (e.g., crashing the boat into a rock).

Step 812 includes providing feedback to the user in response to the interaction. In some embodiments, the feedback is visual or audible. In other embodiments, the feedback is provided by controlling the motor of the paddling simulator to vary a tension in the cable in response to the interaction. To continue the alligator example from above, an interaction could include the alligator biting and pulling the paddle away from the boat, which can be communicated as haptic feedback to the user by increasing the force on the bar 116 by the first motor 112 and/or second motor 114. In some such examples, the user must exert extra power/energy on the bar 116 to wrestle the virtual paddle back from the alligator (thus increasing the intensity of the workout and providing variation in the paddling workout). As another example, a collision of the virtual boat with an obstacle may be considered as damaging the boat, which can be communicated as feedback to the user by increasing the tension in the first cable 118 and the second cable 120 during power phases of a paddling stroke to represent increased difficulty in paddling a damaged boat. Various such examples are possible.

When configured according to the various possibilities, combinations, alternatives, etc. described above, a paddling simulator can be provided that includes enhancements and experiences not found in other exercise devices and which may increase the effectiveness, reality, and/or fun of paddling-related exercises. The paddling simulator and various related process described herein thus provide advantages over conventional rowing machines and other exercise equipment.

Although the examples above refer to paddling, it should be understood that the examples herein could be extend to other types of exercises, for example a swimming simulator in which the first cable 118 and the second cable 120 are strapped directly to a user's hands and tensions generated therein to provide swimming-like forces to the user's hands.

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

The hardware and data processing components used to implement the various processes, operations, illustrative logics, logical blocks, modules and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

What is claimed is:

1. A paddling simulator, comprising:

a bar;

a cable attached to the bar;

a motor operationally coupled to the cable such that the motor can apply a force to the cable;

a controller configured to control the motor to generate a first tension in the cable during a propulsion phase of a paddling stroke and a second tension in the cable during a recovery phase of the paddling stroke;

an additional cable coupled to the bar, wherein the cable extends from a first end of the bar and the additional cable extends from a second end of the bar; and an additional motor operatively coupled to the additional cable.

2. The paddling simulator of claim 1, further comprising a pulley configured to redirect the cable between the bar and the motor, wherein the pulley is repositionable relative to the motor along a vertical direction.

3. The paddling simulator of claim 1, further comprising an inertial measurement unit coupled to the bar and configured to collect data indicative of movement of the bar.

4. The paddling simulator of claim 3, wherein the controller is configured to adjust the first tension based on the data indicative of the movement of the bar.

5. The paddling simulator of claim 3, wherein the controller is configured to:

determine a pose of the bar based on the data from the inertial measurement unit;

determine a virtual pose of a virtual paddle blade relative to a virtual water level based on the pose of the bar; and adjust the first tension based on a relationship between the virtual position of the virtual paddle blade and the virtual water level.

6. The paddling simulator of claim 3, wherein the controller is configured to:

determine a pose of the bar based on the data from the inertial measurement unit;

compare the pose of the bar to a criterion; and adjust the first tension based on whether the pose of the bar satisfies the criterion.

7. The paddling simulator of claim 1, wherein the controller is configured to independently control tensions in the cable and the additional cable by independently controlling the motor and the additional motor.

8. The paddling simulator of claim 1, further comprising a first pulley and a second pulley spaced apart by a distance corresponding to a length of the bar, the first pulley configured to redirect the cable between the motor and the bar and the second pulley configured to redirect the additional cable between the additional motor and the bar.

9. The paddling simulator of claim 1, further comprising a bench configured to transition from a sliding state suitable for a first type of paddling to a stationary state suitable for a second type of paddling.

10. The paddling simulator of claim 1, further comprising:

a sensor configured to generate data indicative of a pose of the bar; and a display device configured to display a visualization of a virtual paddle in a virtual environment based on the data indicative of the pose of the bar.

11. The paddling simulator of claim 10, wherein at least one of the display device or the motor is configured to provide feedback to a user in response to interactions between the virtual paddle and virtual obstacles in the virtual environment based on the data indicative of the pose of the bar.

12. The paddling simulator of claim 1, wherein the second tension is selected to provide an eccentric exercise during the recovery phase.

13. The paddling simulator of claim 1, wherein the controller is configured to automatically adjust the first tension or the second tension during a workout based on a workout plan.

14. A paddling simulator, comprising:

a bar;

a cable attached to the bar;

a motor operationally coupled to the cable such that the motor can apply a force to the cable;

a controller configured to:

control the motor to generate a first tension in the cable during a propulsion phase of a paddling stroke and a second tension in the cable during a recovery phase of the paddling stroke; and determine a steering effect on a virtual boat in a virtual environment based on data indicative of a pose of the bar; and a display device configured to display a visualization of the virtual boat in a virtual environment and adjust the visualization to show a result of the steering effect on the virtual boat in the virtual environment.

15. A method of operating a paddling simulator comprising a bar, a cable attached to the bar, a motor operationally coupled to the cable such that the motor can apply a force to the cable, and a controller, comprising:

controlling, by the controller, the motor to generate a first tension in a cable during a propulsion phase of a paddling stroke performed with a bar coupled to the cable;

controlling, by the controller, the motor to generate a second tension in the cable during a recovery phase of the paddling stroke;

tracking a pose of the bar coupled to the cable using a sensor; and dynamically adjusting the first tension based on the pose of the bar.

16. The method of claim 15, further comprising controlling an additional motor coupled to an additional cable attached to the bar.

17. The method of claim 15, wherein the sensor comprises a camera; and wherein tracking the pose of the bar comprises optically detecting the pose of the bar with the camera.

18. The method of claim 15, wherein dynamically adjusting the first tension based on the pose of the bar comprises:

defining a virtual water level;

determining a position of a virtual paddle relative to the virtual water level based on the pose of the bar; and adjusting the first tension based on the position of the virtual paddle relative to the virtual water level.

19. The method of claim 18, further comprising:

determining a steering effect of the virtual paddle on a virtual boat based on the pose of the bar; and generating a visualization of the virtual boat in a virtual environment based on the steering effect of the virtual paddle on the virtual boat.

20. The method of claim 15, further comprising automatically adjusting the second tension during a workout based on workout plan.

* * * * *